United States Patent [19]

Kopietz et al.

[11] 4,087,290

[45] May 2, 1978

[54] PROCESS FOR THE CONTROLLED COOLING OF FERROUS METAL

[75] Inventors: Karl-Heinz Kopietz, Drexel Hill, Pa.; Francis S. Munjat, late of Rosemont, Pa., by Ada C. Munjat, executrix

[73] Assignee: E. F. Houghton & Co., Philadelphia, Pa.

[21] Appl. No.: 587,735

[22] Filed: Jul. 3, 1975

[51] Int. Cl.[2] ..... C21D 1/48; B23K 35/24; C09K 50/00

[52] U.S. Cl. ..... 148/18; 148/20.6; 148/28; 252/76

[58] Field of Search ..... 148/27, 28, 18, 143, 148/13, 13.1, 20.6; 252/74, 76, 78, 77, 73

[56] References Cited

U.S. PATENT DOCUMENTS

| | | | |
|---|---|---|---|
| 2,600,290 | 6/1952 | Corneil | 148/18 |
| 2,770,564 | 11/1956 | Gordon | 148/18 |
| 3,220,893 | 11/1965 | Blackwood et al. | 148/28 |
| 3,563,895 | 2/1971 | Janatka et al. | 252/77 |
| 3,669,762 | 6/1972 | Takeo et al. | 148/28 |
| 3,939,016 | 2/1976 | Tokuue et al. | 148/28 |

OTHER PUBLICATIONS

Lyman, T., et al; Metals Handbook, II (Heat Treating), Ohio (ASM), 1964, pp. 17, 19, 21.

*Primary Examiner*—Walter R. Satterfield
*Attorney, Agent, or Firm*—Howson and Howson

[57] ABSTRACT

Austenitized ferrous metal, such as carbon steel, is quenched by means of an aqueous solution of a salt of polyacrylic acid which develops an extremely stable and uniform water vapor envelope surrounding the steel. Rate of cooling is controlled by (1) the molecular weight of the salt, (2) concentration of the salt in the solution, (3) solution temperature, and (4) the degree of agitation of the quenchant solution. In the case of carbon steel, by proper selection of the above variables, the austenitic structure of the hot steel may be directly transformed into non-martensitic structures of improved ductility, machinability and cold working properties, such as fine striped pearlite, without the necessity of further heat treatments, such as tempering, following quenching.

The quenching solution may also be used to quench parts formed of alloy steel to obtain a martensitic structure without unwanted cracking and distortion. Nonferrous metals may also be quenched using the polyacrylate quenching solution.

4 Claims, 7 Drawing Figures

PROCESS FOR THE CONTROLLED COOLING OF FERROUS METAL

BACKGROUND OF THE INVENTION

Non-martensitic structures of improved ductility and cold working properties and improved machinability in ferrous metals, in particular in carbon steel, have heretofore been obtained by cooling the austenitized ferrous metal either (1) in one of the usual quenchants, such as water, aqueous solutions, quenching oils or molten salt baths in order to obtain mainly martensitic microstructures, followed by subsequent tempering in order to transform these comparatively hard and brittle structures into more ductile or machinable tempering structures, a process which is known as "quenching and tempering", or (2) in a molten lead bath or salt at a temperature between about 500° and 650° C. in order to obtain directly fine stripped pearlite, a process which is generally known as "patenting".

The conventional and well known aqueous-base quenchants used for quenching to produce non-martensitic microstructures by the "quenching and tempering" process may be used to produce uniform non-martensitic structures. However, such quenching and tempering process, which consists of three stages, namely austenitizing, quenching and tempering, generally produces microstructures, such as spherodite, which are unsuitable for subsequent drawing and certain machining operations. The reason for this is that these quenchants do not develop a vapor envelope at the surface of the metal being quenched which is sufficiently stable and uniform to provide the necessary slow and uniform cooling to obtain the desired fine striped pearlite structure free of martensite.

Accordingly, resort has been made to the use of molten lead and salt baths to obtain the necessary reduced quenching rates which provide the desired non-martensitic structures. However, molten lead and salt baths, used mainly in the patenting process, constitute hazards in the form of destructive fires, burns of the skin of operating personnel, and air and water pollution.

U.S. Pat. No. 2,994,328 discloses the patenting of steel rod immediately after it has been hot rolled by continuously passing the rod through a series of water cooling stands. The patenting conditions are controlled by adjusting the flow of water to each of the water cooling stands. This method requires the use of a number of water cooling stands, is relatively complicated and produces undesirable results, in particular, the formation of coarse pearlite, which has only limited ductility and cold working properties.

U.S. Pat. No. 3,231,432 discloses a patenting process in which austenitized steel wire is cooled by means of forced gas. Unfortunately, it is considerably more difficult to control the rate of cooling in this manner than by use of a liquid quenchant. In addition, such process can be employed only with a limited number of alloys and with rod of a limited range of diameters.

U.S. Pat. No. 3,669,762 proposes the patenting of hot rolled carbon steel rod by quenching in hot water which is supposed to generate a stable steam envelope around the rod. The water quenchant, which may contain 0.1 to 2.0%, by weight, of a surface active agent, is at a temperature of 45° C. to 100° C., preferably 70° C. to 100° C., and should not vary by more than 5° C. from the selected temperature. The process is limited to patenting of steel rod which is free of rough or coarse scale on its surface, because such type surface would cause the steam film to collapse resulting in the formation of areas of martensite in the wire. The presence of such areas is extremely undesirable, since breaking of the wire during subsequent coiling or drawing process takes place in such areas.

In quenching parts formed of alloy steels to obtain a martensitic structure various problems have arisen using available quenchants. Not infrequently the quenched parts have been cracked and/or distorted. Accordingly, there has been a need for quenchant solutions which, by adjusting various parameters thereof, make possible a wide selection of cooling rates whereby parts having the desired microstructure free of defects can be obtained.

It is a primary object of the present invention to provide a new and useful process for the cooling of austenitized ferrous metal parts with the aim to produce therein non-martensitic microstructures having improved ductility and cold working properties, and improved machinability, such as fine striped pearlite without post quenching heat treatments.

Another object is to provide a process in which parts of austenitized ferrous metal are quenched in comparatively cool aqueous polyacrylate salt solutions whose parameters are such as to provide uniform, low cooling rates by reason of the development of a stable and uniform envelope of steam at the surface of the parts, whether or not such surfaces are rough or are covered with rough or coarse scale.

Still another object of the invention is to provide a quenching process in which cooling rates can be varied widely, but which is not temperature sensitive, whereby substantial fluctuations in the temperature of the quenching solution do not impair the uniformity of the quality of the quenched parts.

A still further objective is to provide a process for quenching parts formed of alloy steels to obtain therein martensitic structures, the quenched parts being free of undesirable cracks and distortion.

Another object is to provide a quenching process in which the liquid medium of the quenching bath is non-flammable, non-explosive, non-toxic, and non-pollutive, whereby injury to operating personnel and environmental pollution are avoided.

These and other objects of this invention will become further apparent from a consideration of this specification, appended claims and drawings in which:

Figure 4:
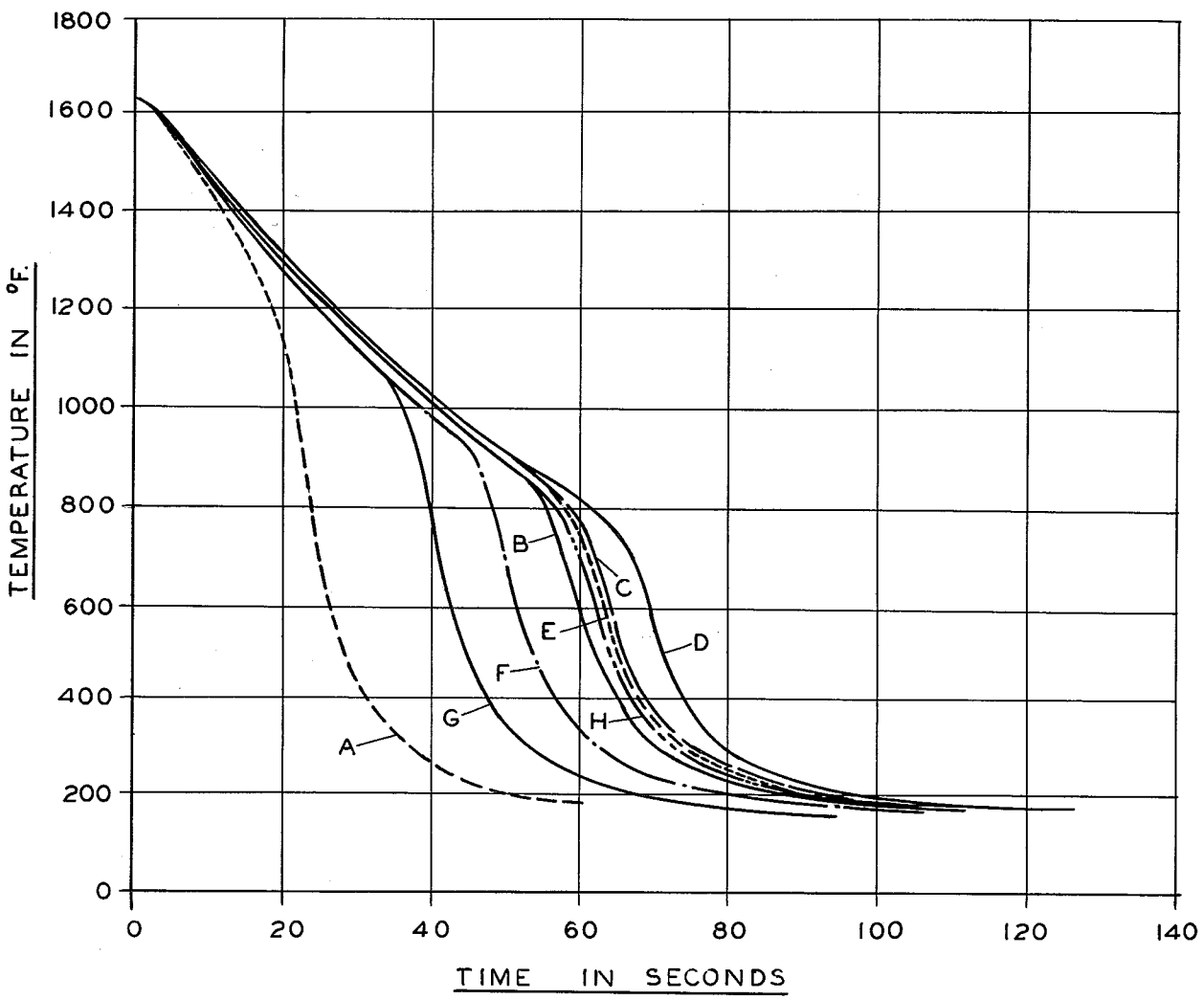

FIG. 4 contains a series of continuous cooling curves for a steel cylinder quenched in aqueous solutions of various polyacrylates identified in Table I.

Figure 5:
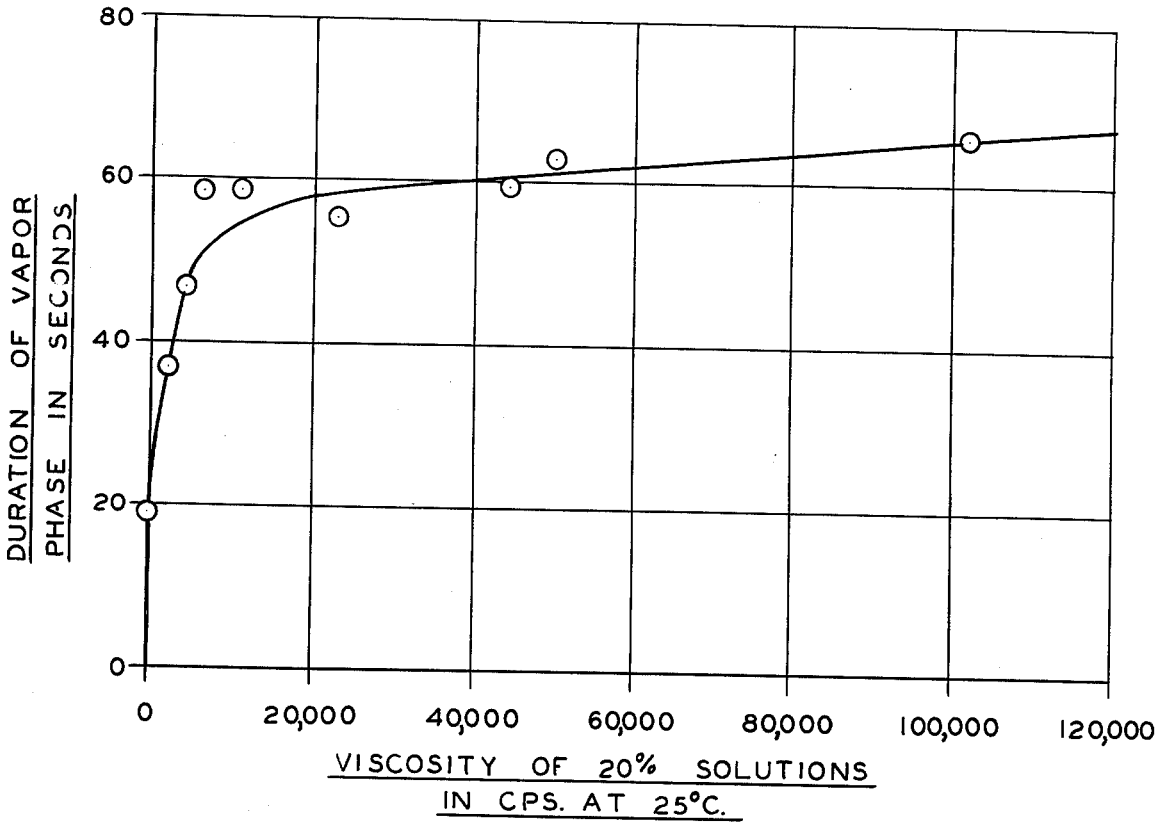

FIG. 5 illustrates curves showing duration of vapor phase vs. molecular weight of various polyacrylates during quenching of a steel cylinder in aqueous solutions of such polyacrylates.

Figure 6:
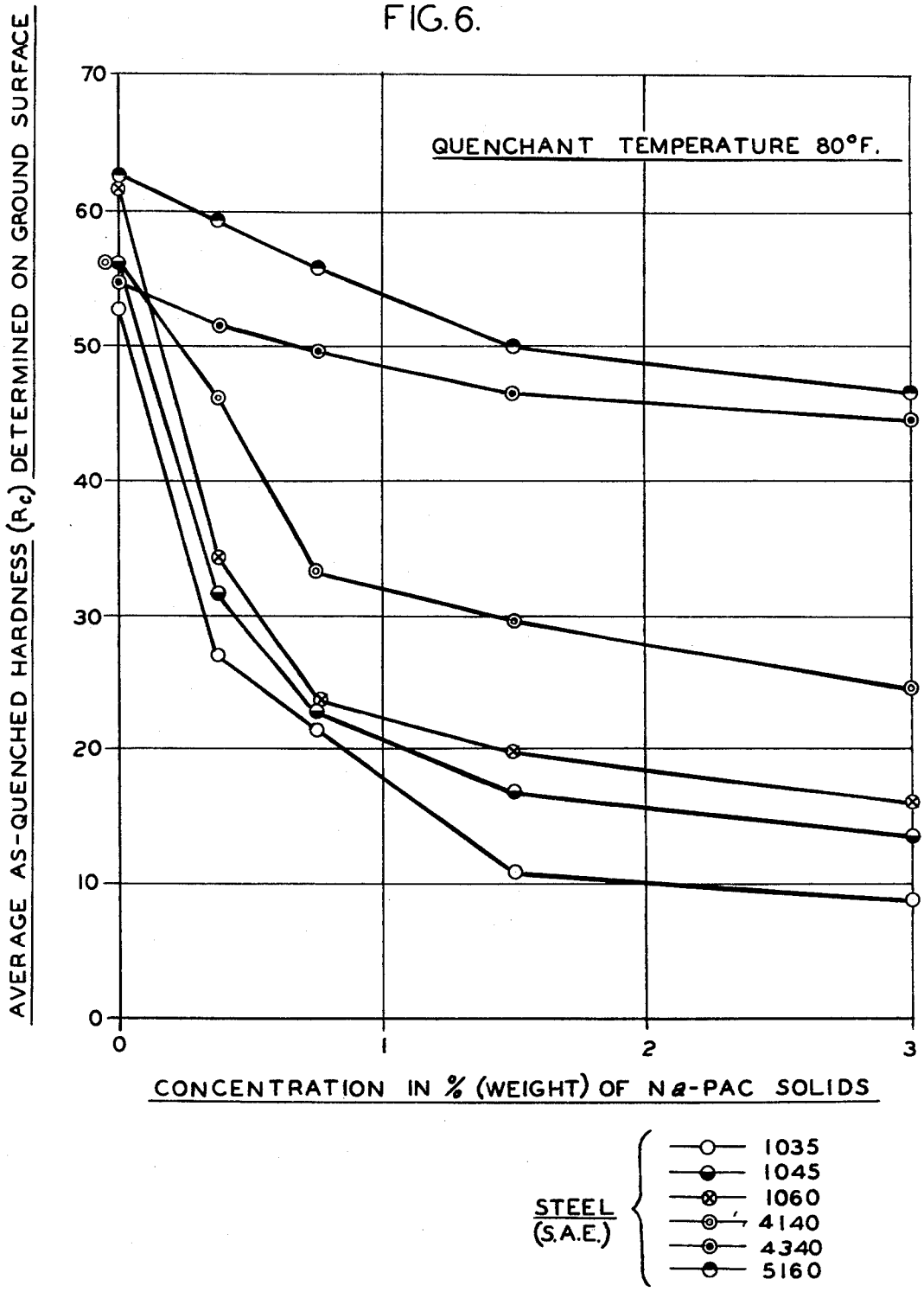

FIG. 6 presents a series of curves showing as-quenched Rockwell C hardness values for steel specimens quenched in aqueous solutions of sodium polyacrylate of various conncentrations.

Figure 7:
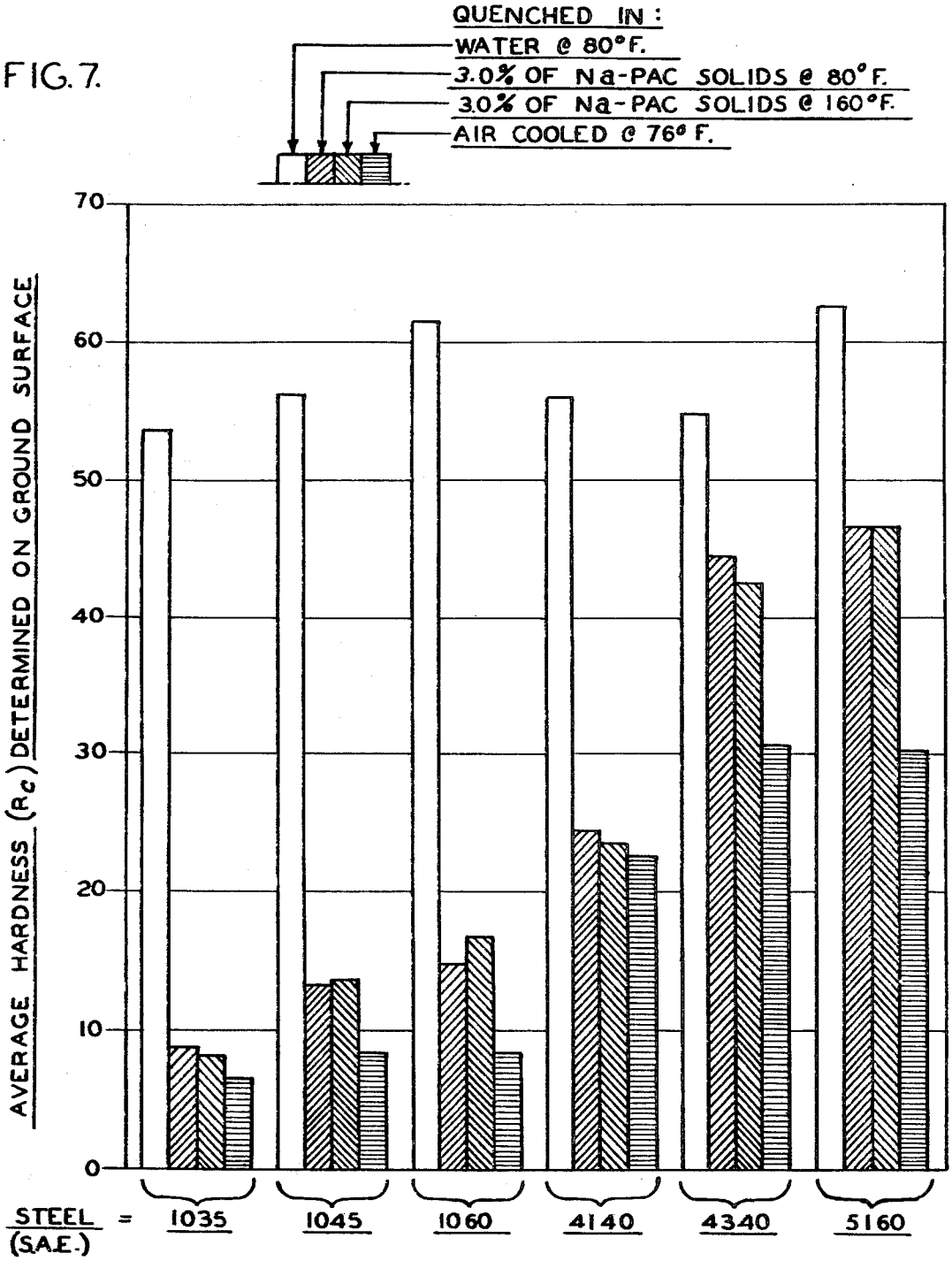

FIG. 7 is a bar chart in which are compared as-quenched hardness values for specimens of various types of steel quenched in water, air and aqueous solutions of sodium polyacrylate.

SUMMARY OF THE INVENTION

The present invention relates to improvements in the heat treatment of metals, particularly ferrous metals such as carbon steels and allow steels, to effect desirable metallurgical changes in the metal. More particularly, this invention is directed to a process of quenching which is useful in the heat treatment of metals wherein the metal to be treated is heated to an elevated temperature and then the heated metal is quenched in a liquid quenching medium which is an aqueous solution of a water-soluble salt of polyacrylic acid to effect desirable metallurgical changes in the metal.

The process is particularly advantageous in the heat treatment of carbon steel wire or rod to provide a non-martensitic microstructure of improved ductility and cold working properties which permits the wire or rod to be drawn without further heat treatment. The process may also be utilized for cooling of hot-formed steel parts in order to obtain such a non-martensitic microstructure directly and without subsequent heat treatment. A further application of the process is in the cooling of ferrous metal castings, in particular malleable iron castings, in order to obtain non-martensitic structures, such as fine striped pearlite, also without subsequent heat treatment.

The process is applicable to treatment of carbon steel, alloy steel and ferrous metal castings, and provides a novel method of quenching to obtain non-martensitic structures in ferrous metals, which structures were obtainable for the most part heretofore only by (1) quenching to produce martensitic microstructures, and subsequent tempering, or (2) by quenching slowly in a hot lead or salt bath. The new process is advantageous in several aspects, such as (1) improved economy, (2) less or no pollution, (3) no fire hazard, (4) no danger of burnings of human skin by contacting the hot lead or salt bath and (5) easy control of the cooling effect.

The process of the invention is such that by selection of the molecular weight of the polyacrylic salt, the concentration thereof in the aqueous quenching solution, and of the rate of agitation of the solution during quenching, a stable and uniform envelope of water vapor is formed around the hot metal parts, which envelope causes an extremely low rate and uniform cooling of the metal, so that the non-martensitic microstructure can be obtained.

While even a very small amount of the salt of polyacrylic acid dissolved in water will increase the duration of the vapor phase about the part quenched, as compared to that obtained by the use of water alone, in practical applications a minimum of about 0.1% by weight of the salt ordinarily will be used. Similarly, an upper practical limit on the concentration of the salt is about 6% by weight, although it is possible to use even higher concentrations.

While agitation of the quenching solution is unnecessary and tends to increase the rate of cooling, particularly during the vapor phase period, in many cases moderate agitation may be desirable to increase the uniformity of the cooling action of the quenchant. Advantageously, such agitation may be employed without adversely affecting the physical properties of the bath.

The effectiveness of the salt of the polyacrylic acid in extending the duration of the vapor phase period is also dependent on the molecular weight of the particular salt used, and as a general rule, the duration of the vapor phase increases with increasing molecular weight. A practical lower limit of molecular weight is such that an aqueous solution containing 20% by weight of said salt has a viscosity of at least about 700 centipoises at 25° C. In most applications the molecular weight should be at least about that corresponding to a viscosity of about 5,000 at 25° C. While the upper limit of the molecular weight is not critical and may correspond to a viscosity 100,000 centipoises or more, the preferred range of molecular weight is that corresponding to a viscosity from about 25,000 to about 75,000 centipoises at 25° C. for a 20% solution. The aforesaid viscosities are those measured by means of a Brookfield RVT model at 10 RPM.

The quenching rate generally decreases with increasing quenchant temperatures measured prior to contact by the immersed metal, the preferred range of quenchant temperatures being about 70° to about 160° F. for most practical uses, although lower temperatures such as about 60° F. may be used, as may be temperatures above the preferred upper temperature of about 160° F., such as temperatures up to 212° F.

By adjustment of the above-mentioned factors of temperature of the liquid quenching medium, concentration and molecular weight of the polyacrylic acid salt used in the quenching medium, and the use, non-use and degree of agitation, a comparatively wide range of cooling characteristics can be obtained, which range is much wider than that obtainable with other known aqueous solutions.

In addition to the essential polyacrylate salt, the aqueous quenching bath may contain other additives to improve performance in certain applications. For example, there can be added to the bath corrosion inhibitors such as sodium nitrite, ethanol amine or amine soaps, which prevent corrosion of quench tanks, conveyor belts and the quenched parts, as well as other additives, including defoamers, biocides, metal deactivators, etc.

The aqueous quenching medium of the invention is relatively inexpensive, non-explosive, substantially non-poisonous and of very low toxicity to humans. In addition, the medium is substantially non-pollutive of the environment. Furthermore, the aqueous quenchant does not adhere to the treated metal parts when they are removed from the quenching bath before the stable vapor envelope collapses. Hence the parts do not require any washing-off thereby avoiding the production of waste liquid which must be disposed. However, even if the metal part is cooled to the temperature of the quenching solution, whereby the solution forms an adhering film on the surface of the metal part when it is removed from the bath, the resulting waste liquid after rinsing does not cause any lasting pollution since the residues of the salts are biodegradable and have a moderate oxygen demand.

While the water-soluble salt of polyacrylic acid which may be used is not critical to obtaining desirable results, the particularly preferred salt is sodium polyacrylate. Comparable performance also can be obtained with potassium polyacrylate, lower alkylamine polyacrylates, such as methyl, ethyl, propyl and butyl mono-, di- and tri-polyacrylates, lower alkanolamine polyacrylates, such as mono-, di- and tri-ethanol and isopropanolamine polyacrylates, and ammonium polyacrylate, diethanolamine polyacrylate, triethanolamine polyacrylate and ammonium polyacrylate.

DESCRIPTION OF SPECIFIC EMBODIMENTS

The data set forth hereinafter were obtained using test procedures involving direct measurements of the temperature of a heated metal test specimen at specified times after the immersion thereof in the cooling medium, using a thermocouple inserted into the center of the test specimen.

The term "vapor phase" as used herein refers to that part of the cooling cycle, beginning with the immersion of the heated metal part into the quenching bath, during which the hot surfaces of the metal part causes the formation of a thin envelope or film of vapor on such surfaces. The thermal conductivity of this film is extremely low and, therefore, results in a relatively slow transfer of heat from the heated part to the quenching bath as long as the film exists. The longer the duration of the vapor phase and the thicker the film, the slower the cooling rate. The tests described hereinafter and the data obtained thereby which has been plotted in the form of cooling curves in the accompanying drawings, show that the effect of the polyacrylate salt is to extend the duration of the vapor phase, and thus reduce the cooling rate. The curves show that cooling rate decreases with increase in the concentration of the polyacrylate salt and molecular weight of the polyacrylate, and with increase in the temperature of the bath. However, the extension of the vapor phase is less pronounced when the bath is agitated, although generally a minor amount of agitation is desirable to improve uniformity of the cooling action of the bath, provided the agitation is sufficient to reduce significantly the desirable effects of the polyacrylate in extending the duration of the vapor phase.

TEST PROCEDURES FOR OBTAINING COOLING CURVES

The test specimen was a cylinder 120 millimeters long and 20 millimeters in diameter, and composed of non-scaling austenitic steel AISI 302 B. A miniature Chromel-Alumel thermocouple was inserted into the center of the cylinder, and the temperature-representing output of the thermocouple was recorded by means of a strip chart recorder (Speedomax H, Model S from Leeds & Northrup, North Wales, Pa.). The test specimen was heated in an electric furnace with a hole in the door through which the test specimen was introduced. The furnace was operated without a controlled atmosphere and adjusted to 925° C. (1700° F.). In each test, the temperature of the test specimen at the time of immersion in the quenchant was 849° C. (1620° F.). The quantity of quenchant used was 3.0 liters, and means were provided for heating the quenchant to various temperatures which were measured by a thermometer immersed in the quenchant. Slightly turbulent agitation whereby the quenchant was circulated with respect to the test specimen of about 10 centimeters per second was provided by a laboratory stirrer.

Several cooling curves were obtained using the above test conditions and aqueous solutions of different polyacrylic salts. The polyacrylic salts used are listed in Table I which sets forth their composition and viscosity.

TABLE I

| PRODUCT NUMBER | COMPOSITION | DYNAMIC VISCOSITY IN CPS AT 25° C.* |
|---|---|---|
| 1 | Sodium Polyacrylate | 22,800 |
| 2 | Sodium Polyacrylate | 44,300 |
| 3 | Sodium Polyacrylate | 102,000 |
| 4 | Potassium Polacrylate | 11,000 |
| 5 | Diethanolamine-Polyacrylate | 4,100 |
| 6 | Triethanolamine Polyacrylate | 2,100 |
| 7 | Ammonium Polyacrylate | 6,400 |
| 8 | Sodium Polyacrylate plus Corrosion Inhibitors | 50,000 |

*Determined on a 20% aqueous solution by means of Brookfield RVT Viscosimeter at 10 RPM.

Each cooling curve in FIGS. 1, 2, 3 and 4 shows the decrease in the temperature of the test specimen with time after immersion in the quenching bath used in the particular test. The ordinates of these figures represent temperature of the test specimens in ° F., as measured by the thermocouple, and the abscissae represent time in seconds measured from the instant of immersion of each specimen in the quenchant bath. The temperature and time scales are the same for all figures.

Figure 1:
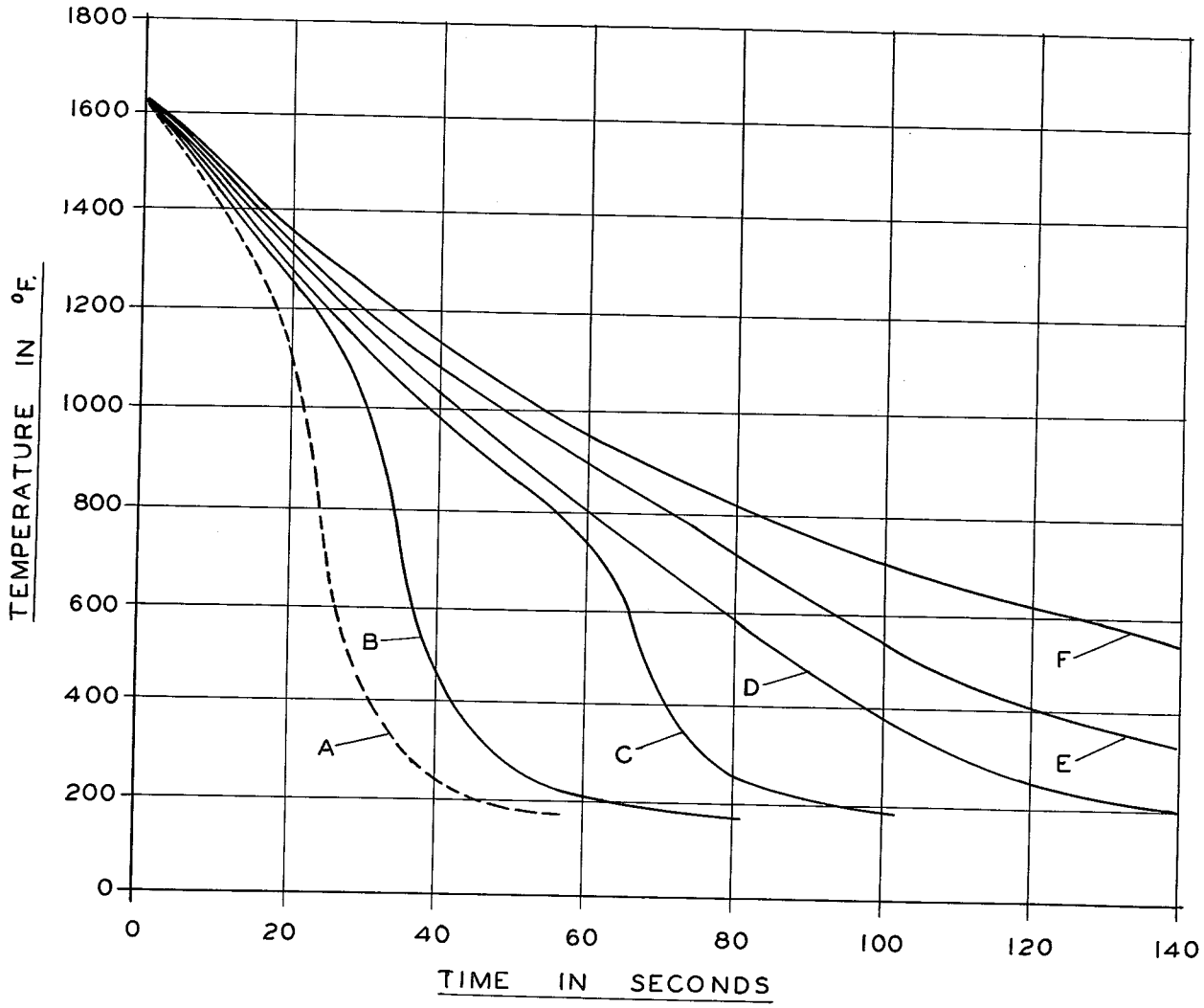
FIG. 1 illustrates a series of continuous cooling curves for a steel cylinder quenched in water (curve A) and in aqueous solutions of sodium polyacrylate at various concentrations (curves B to F).

The cooling curves of FIG. 1 were obtained with aqueous solutions of sodium polyacrylate having a viscosity of 50,000 cps at 25° C. for a 20% solution (Product 8, Table I). The control bath was water. The temperature of the several baths was 140° F. In FIG. 1, curves A, B, C, D, E and F are for 0% (water), 0.1%, 0.5%, 2.0%, 4.0% and 6.0% aqueous solutions of the polyacrylate, respectively.

The curves B, C, D, E and F obtained using sodium polyacrylate solutions show that as the concentration of polyacrylate is increased, cooling rate is reduced and the vapor phase period is increased. Even a concentration 0.1% (Curve B) produces a substantially slower rate of cooling and a longer vapor phase period than water alone (Curve A).

The curves in FIG. 1 are smooth and quite regularly spaced from each other for the progressively increasing concentrations of polyacrylate. The cooling curves for the solutions with more than 2.0% of the polyacrylate (Curves D, E and F) are quite interesting in that they are almost straight and do not exhibit the usual faster quenching effect during the boiling and convention ranges, e.g. as shown by Curve C, which was obtained with a 0.5% solution. These distinctions in the shapes of the curves indicate parts formed of austenitized ferrous metal may be cooled to the temperature of the quenchant without the danger of the formation of undesirable microstructures, such as martensite or bainite, even if the microstructure of the parts has not been completely transformed into pearlitic structures during the cooling period provided by the vapor phase.

Figure 2:
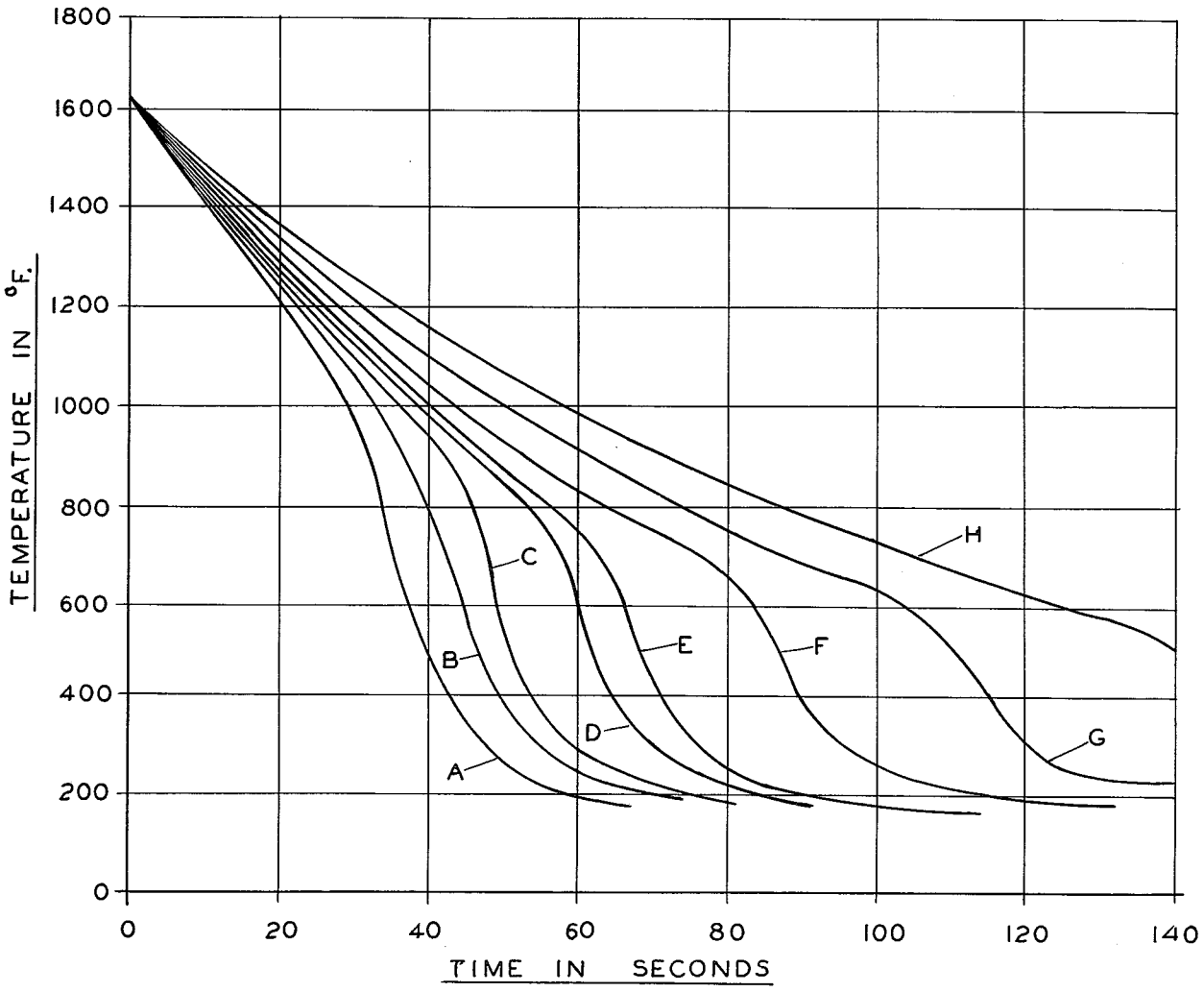
FIGS. 2 and 3 illustrate a series of continuous cooling curves for a steel cylinder quenched in 0.5% and 2.0% aqueous solutions of sodium polyacrylate, respectively, at various temperatures in the range of 60° to 200° C.
Figure 3:
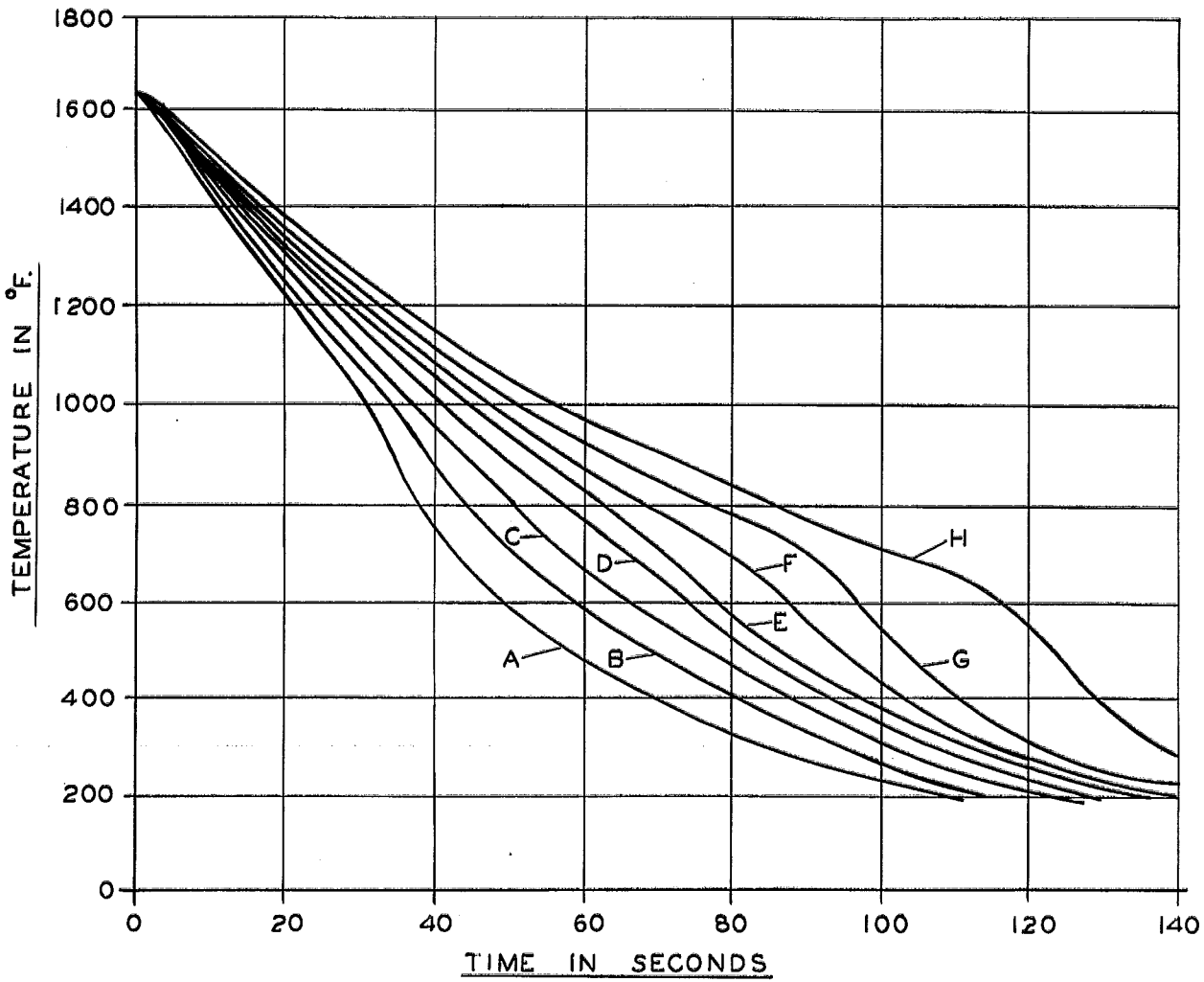

FIGS. 2 and 3 show cooling curves for aqueous solutions of the same sodium polyacrylate (Product 8, Table I), and the effect of bath temperature on cooling rate. The aqueous quenching solutions of FIG. 2 contain 0.5% polyacrylate, whereas those of FIG. 3 contain 2.0% polyacrylate. In each of FIGS. 2 and 3 the curves designated A, B, C, D, E, F, G and H represent bath temperatures of 60°, 80°, 100°, 120°, 140°, 160°, 180° and 200° F., respectively.

The several cooling curves of FIGS. 2 and 3 show that as the bath temperature increases, there is an increasingly longer vapor phase period combined with a decreasing cooling rate. These figures also show that even the very low quenchant temperature of only 60° F. (Curves A) provide cooling characteristics which permit the formation of non-martensitic structures in ferrous metals. However, for practical purposes, temperatures of the solutions above 60° F. are preferred.

FIG. 4 contains cooling curves for water along (Curve A), and for solutions of several polyacrylate products, Products Numbers 1–7, Table I, being indicated as Curves B to H, respectively. The bath temperature was 140° F. and the concentration of polyacrylate was 0.4% in each test. These curves show that the sodium, potassium, ammonium and alkanolamine salts of polyacrylic acid may be used with good results, and that the molecular weight of the polyacrylate has a greater effect on cooling rate than the particular cation.

FIG. 5 is a plot of duration of vapor phase (seconds) vs. molecular weight of polyacrylate (expressed in terms of viscosity) for the quenching baths of FIG. 4 (Water and Products Nos. 1–7, Table I). The curve in FIG. 5 was plotted using as points the break in the curves of FIG. 4. FIG. 5 shows that the length of time of the vapor phase increased with increasing molecular weight of the polyacrylate.

TEST PROCEDURES FOR STEEL SAMPLES

The tests below described were conducted to show the metallurgical changes in ferrous metal when heat treated according to the process of this invention.

In these tests three carbon steels, namely SAE 1035, 1045 and 1060, and three alloy steels, namely SAE 4140, 4340 and 5160 were used. With the exception of the SAE 5160 alloy steel, the test specimens were 86 mm in length cut from hot rolled and annealed 25.4 mm diameter round bar stock. The test specimens of SAE 5160 alloy steel were 7.8 × 64 × 86 mm. Eight samples of each type of steel were used in the tests.

Four different aqueous quenching solutions were used, each containing sodium polyacrylate, the dynamic viscosity of a 20% solution of which was 50,000 cps. at 25° C. The concentrations of the polyacrylate in the respective baths were 0.376%, 0.75%, 1.5% and 3.0%, respectively, all of said percentages being by weight. In addition, a water quenchant (no polyacrylate) was used as a control. The temperature of the quenching solution prior to immersion of the test specimens therein was 80° F. or 160° F.

Each specimen was quenched individually in about 18 liters of quenchant in a 5 gallon (18.93 liters) bucket. The quenchant was agitated at about 60 cm/sec. by means of a propeller mixer (Dayton Drill Model 2Z393 A, 1/6 HP); and a vertical baffle (plate) was located in the bath to cause upward flow of quenchant in the area of the test specimen.

Prior to quenching, all test specimens were heated to the austenitizing temperatures for the particular steel as set forth in Table II, below, using an electrically heated (resistance) furnace. The total heating time in each instance was 30 minutes, each specimen being soaked at the stated austenitizing temperature for about 20 minutes.

TABLE II

| Steel Type SAE | Austenitizing Temperature |
|---|---|
| 1035 | 843.3° C. (1550° F.) |
| 1045 | 843.4° C. (1550° F.) |
| 1060 | 843.3° C. (1550° F.) |
| 4140 | 882.2° C. (1620° F.) |
| 4340 | 843.3° C. (1550° F.) |
| 5160 | 843.3° C. (1550° F.) |

Each test specimen was quenched for a period of five (5) minutes, at the end of which time each specimen had been cooled to about the temperature of the quenchant.

Following quenching, each specimen was ground to a depth of about 1 mm to remove any scale and any decarburized surface layer. The Rockwell C hardness of each test specimen was then determined by making ten indentations on each specimen. The results of the above-described tests are set forth in Table III below.

For the purposes of comparison test specimens of each of the several types of steel were cooled in still air and the Rockwell C hardness for these specimens is also set forth in Table III.

TABLE III

| Quenchant | Water | Aqueous Solutions of Sodium Polyacrylate | | | | | | Still Air |
|---|---|---|---|---|---|---|---|---|
| Concentration in % by wt. | 100 | 0.376 | 0.75 | 1.5 | 3.0 | 1.5 | 3.0 | 100 |
| Temperature in ° F. | 80 | 80 | 80 | 80 | 80 | 160 | 160 | Approx. 77 |
| | ROCKWELL HARDNESS* | | | | | | | |
| Steel Type SAE | | | | | | | | |
| 1035 | 53.4–54.0 (53.7) | 26.0–28.0 (27.0) | 21.0–22.0 (21.5) | 10.4–10.8 (10.6) | 8.5–9.2 (8.9) | 8.5–9.0 (8.8) | 8.0–8.2 (8.1) | 6.0–7.0 (6.5) |
| 1045 | 56.0–56.2 (56.1) | 29.0–34.0 (31.5) | 22.8–23.0 (22.9) | 16.6–17.0 (16.8) | 13.0–13.5 (13.3) | 12.5–13.0 (12.8) | 13.5–14.0 (13.8) | 8.2–8.5 (8.4) |
| 1060 | 61.2–62.0 (61.6) | 33.0–35.2 (34.1) | 23.0–23.5 (23.3) | 19.6–20.0 (19.8) | 15.5–16.2 (15.9) | 16.0–16.5 (16.3) | 16.5–17.0 (16.8) | 8.0–8.5 (8.3) |
| 4140 | 56.0–56.2 (56.1) | 45.0–47.2 (46.1) | 33.0–33.2 (33.1) | 29.0–30.0 (29.5) | 24.0–24.5 (24.3) | 24.5–25.0 (24.8) | 23.0–24.0 (23.5) | 20.0–25. (22.6) |
| 4340 | 54.5–55.2 (54.9) | 51.0–52.0 (51.2) | 49.0–50.0 (49.5) | 46.0–46.6 (46.3) | 44.0–45.0 (44.5) | 46.0–46.0 (46.0) | 42.0–43.0 (42.5) | 29.0–32. (30.5) |
| 5160 | 62.5–63.1 (62.8) | 58.0–60.5 (59.3) | 56.8–57.0 (56.9) | 49.6–50.2 (49.9) | 46.0–47.0 (46.5) | 55.0–56.0 (55.5) | 46.0–47.0 (46.5) | 29.0–31. (30.0) |

*numbers separated by a hyphen represent the range of test values obtained; those in parentheses are average values.

FIG. 6 sets forth a series of curves in which the average as-quenched Rockwell C hardness values of the steel specimens are plotted as a function of concentration of the polyacrylate in the quenchant, the temperature of the quenchant being 80° F.

FIG. 7 is a bar chart in which the average as-quenched hardness of each steel specimen quenched in water alone at 80° F., and those which were air cooled, are compared with average hardness of specimens quenched using a 3% polyacrylate solution according to this invention, the polyacrylate quenchants being at a temperature of either 80° or 160° F.

The foregoing tests show that as the concentration of the polyacrylate in the aqueous quenching solution increases, the quenching rate decreases. The data in Table III and FIGS. 6 and 7 also show that by means of the present invention carbon steels (e.g. SAE 1035, 1045 and 1060) are not hardened when quenched in aqueous solutions of polyacrylate, even at concentrations as low as 0.375%. A bath having a concentration of 1.5% polyacrylate provides Rockwell C hardness values for carbon steel below 20 and similar to those obtained by air cooling. Thus the process of this invention makes possible the obtaining of non-martensitic microstructures directly. Of course, by varying such quenching bath parameters as concentration and molecular weight of the polyacrylate, bath temperature and degree of agitation, parts having various degrees of hardness may be obtained.

The data in Table III and FIGS. 6 and 7 also show that according to the present invention alloy steels (SAE 4140, 4340, and 5160) can be quenched to produce desired martensitic microstructures. FIGS. 6 and 7 further show that 25.4 mm diameter specimens of a higher alloy steel (SAE 4340) and thin specimens (7.8 mm thick) of such type steel (SAE 5160) can be quenched to mainly martensitic structures using as a quenchant bath a 3% aqueous solution of polyacrylate. Advantageously, the alloy steels, even the higher alloy steels can be quenched to obtain martensitic microstructures according to this invention without cracking or warping of the quenched parts. Such alloy steels heretofore have been quenched in oil or salt baths.

The terms "carbon steel" and "alloy steel" as used in this specification and appended claims are intended to be accorded their accepted definition as set forth for example in 1974 SAE Handbook, Society of Automotive Engineers, Inc., 1974, Part 1, pages 52–54 (SAE J411d).

Although the process of this invention is particularly useful in heat treating of ferrous metals and has been described in detail in connection therewith, it may also be used to advantage in treating non-ferrous metal alloy such as aluminum alloys.

What is claimed is:

1. In a process of quenching which is useful in the heat treatment of metals wherein a metal is heated to an elevated temperature and said heated metal is then quenched in a bath comprising a liquid quenching medium to effect desirable metallurgical changes in the metal, the improvement which comprises using as said quenching medium an aqueous solution containing from about 0.1% to about 6% by weight of a water-soluble salt of polyacrylic acid selected from the group consisting of sodium, potassium, ammonium, lower alkylamine and lower alkanolamine polyacrylates, and mixtures thereof, said salt having a molecular weight such that an aqueous solution thereof containing 20% by weight of said salt has a viscosity of from about 5,000 to about 100,000 centipoises at 25° C.

2. In a process of quenching which is useful in the heat treatment of steel wherein said steel to be heat treated is heated to an austenitizing temperature and said heated steel is then quenched in a bath comprising a liquid quenching medium to provide said steel with a non-martensitic microstructure of improved ductility and cold working properties, the improvement which comprises using as said quenching medium an aqueous solution containing from about 0.1% to about 6% by weight of a water-soluble salt of polyacrylic acid selected from the group consisting of sodium, potassium, ammonium, lower alkylamine and lower alkanolamine polyacrylates, and mixtures thereof, said salt having a molecular weight such that an aqueous solution thereof containing 20% by weight of said salt has a viscosity of from about 5,000 to about 100,000 centipoises at 25° C.

3. A process according to claim 1 in which said salt has a molecular weight such that an aqueous solution containing 20% by weight of said salt has a viscosity of from about 25,000 to about 75,000 centipoises at 25° C.

4. A process according to claim 2 in which said salt has a molecular weight such that an aqueous solution containing 20% by weight of said salt has a viscosity of from about 25,000 to about 75,000 centipoises at 25° C.

* * * * *